US005887454A

United States Patent [19]

Renzacci

[11] Patent Number: 5,887,454

[45] Date of Patent: Mar. 30, 1999

[54] DRY-CLEANING MACHINE WITH STEAM HEATED DRYING AIR

[75] Inventor: Gabrio Renzacci, Citta' Di Castello, Italy

[73] Assignee: Renzacci S.P.A. Industria Lavatrici, Citta' Di Castello, Italy

[21] Appl. No.: 867,841

[22] Filed: Jun. 3, 1997

[30] Foreign Application Priority Data

Jan. 31, 1997 [IT] Italy ..... FI970016 U

[51] Int. Cl.[6] ..... D06F 43/08

[52] U.S. Cl. ..... 68/18; 68/20

[58] Field of Search ..... 68/18 R, 18 C, 68/20

[56] References Cited

U.S. PATENT DOCUMENTS 3,391,550 7/1968 Williams ..... 68/18 C X 3,610,002 10/1971 Carpigiani ..... 68/18 C 3,664,806 5/1972 Victor ..... 68/18 C X 3,692,467 9/1972 Durr et al. ..... 68/18 C X

*Primary Examiner*—Philip R. Coe

*Attorney, Agent, or Firm*—Browdy and Neimark

[57] ABSTRACT

A dry-cleaning machine for linen and garments includes a drum (2) containing the garments and/or linen to be washed, rotating inside a washing tank (1). The tank is connected with a solvent circulation system including a device (3) for continuously distilling the solvent heated up with steam produced by an electric heater (11). The tank also communicates with a drying air circulation system, which comprises a heat exchanger (15) installed upstream from air inlet to the tank and using the steam produced inside the distillation device (3) as a heating medium. This results in lower electric power installation requirements and energy saving.

5 Claims, 1 Drawing Sheet

DRY-CLEANING MACHINE WITH STEAM HEATED DRYING AIR

FIELD OF THE INVENTION

The present invention relates to a dry-cleaning machine for linen and garments, operating with continuous solvent distillation, in which the drying air is heated up without the direct use of resistors.

PROIR ART

In conventional dry-cleaning machines, the rotating washwheel, which contains the garments and/or linen to be washed with an organic solvent, is connected with a solvent circuit which comprises a device for continuously distilling the same solvent, which is heated up with steam produced in a vaporization chamber through the heating by means of resistors. The washwheel also communicates with a second circuit, in which the drying air is circulated by a fan and heated up by a resistor before it enters the washwheel.

Although the use of dry-cleaning machines with continuous distillation offers unquestionable advantages in terms of washing quality, it has been reduced due to high consumption and the high electric capacity installed, i.e., the need for installation of circuits with high electrical capacity.

SUMMARY OF THE INVENTION

The present invention is aimed at providing a dry-cleaning machine with continuous solvent distillation, operating with low consumption and lower installed electric capacity compared to known washing machines.

This result has been reached with the dry-cleaning machine according to the invention in which the drying air is heated up, not with a resistor, but by using steam continuously produced inside the vaporization chamber located in the solvent distilling system. In this way, it is possible to reduce the electric capacity required, and less electric power is consumed during operation thanks to the use of heat produced for distillation.

BRIEF DESCRIPTION OF THE DRAWING

The invention will now be explained in greater detail in the following description of a possible embodiment intended only as an example and not a limitation, with reference to the drawing enclosed, which schematically shows the washing machine according to the invention.

DESCRIPTION OF THE PREFERRED EMBODIMENT

Figure 1:
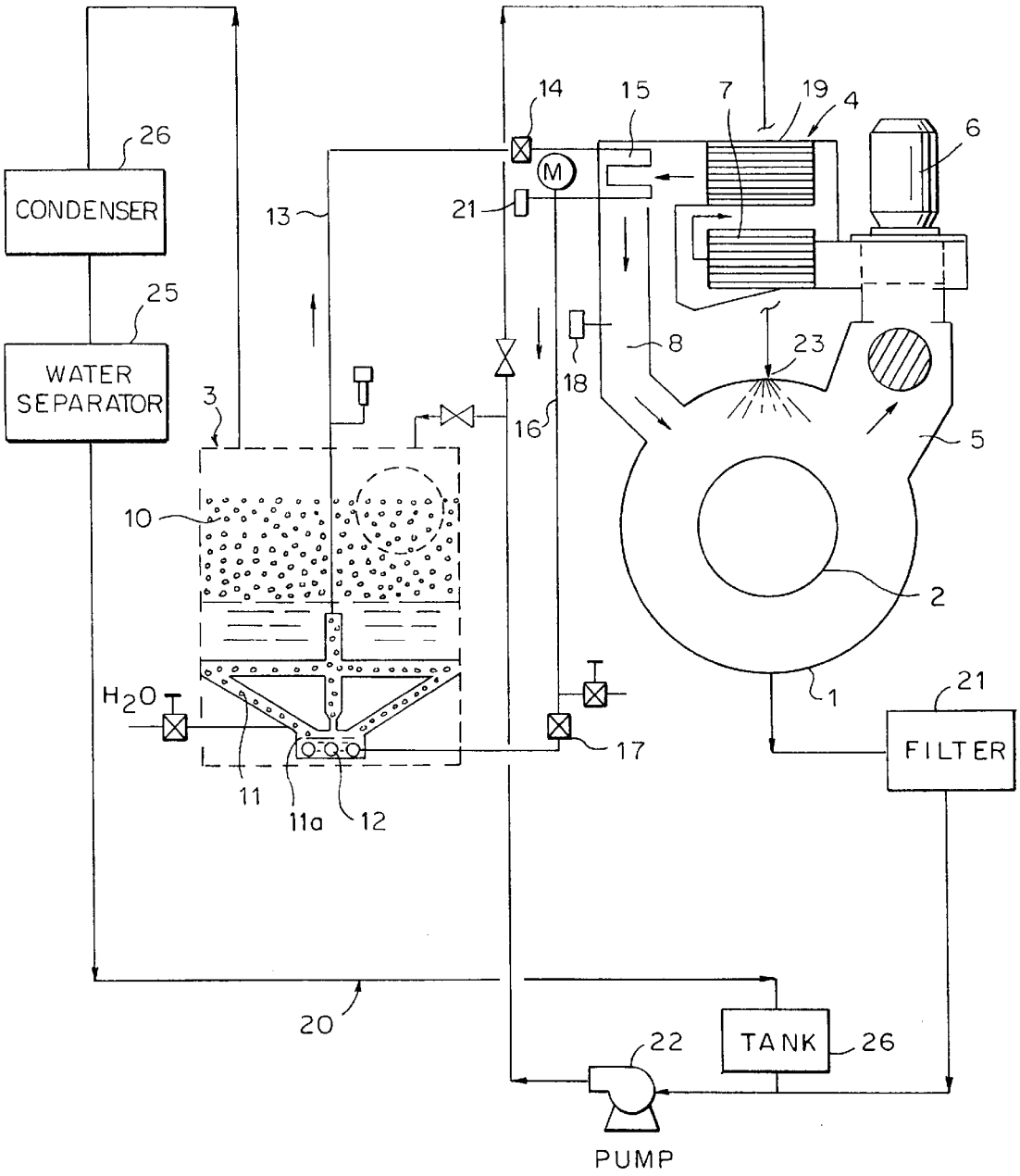

Referring to the above-mentioned figure, the reference numeral 1 indicates a washing tank of the washing machine according to the invention, which houses a rotating drum or basket 2 capable of containing the garments and/or linen to be washed. Tank 1 communicates with a solvent distiller 3 through a solvent circulation system 20 of a conventional type. Tank 1 also communicates with a drying air circulation system, generally indicated as 4, which comprises an outlet pipe 5 for the air entraining the solvent removed from the garments inside drum 2, a fan 6, a cooling unit 7, which separates the solvent from the air by condensation, an air preheating unit 19 (heat pump of the cooling unit), and an inlet pipe 8 to allow the preheated air to flow into tank 1.

The conventional circulation system for circulating the solvent 20, as shown in FIGURE 1, sprays solvent into the washing tank 1 as denoted by arrow 23. The solvent line is shown in broken view where its run is interrupted by the heat exchangers 7 and 19. The solvent spray line is pressurized by a pump 22 fed from a return line coming from the bottom of the washing tank 1 through a filter 21, and from a solvent tank 26 which is fed from the distiller 3 through a condenser 26 and a water separator 25.

Distiller 3 comprises a solvent vaporization chamber 10 which houses a steam heater 11 comprising a sump 11*a*, in which resistors 12 are installed to supply the heat required for continuously vaporizing water.

According to the present invention, heater 11 communicates with a heat exchanger 15 by means of a conduit 13 through a solenoid valve 14. The heat exchanger 15 is installed in the drying air circuit downstream from preheating unit 19 on inlet pipe 8 which conveys preheated air to tank 1. A condensate return pipe 16 connects heat exchanger 15 to sump 11*a* of heater 11 through electrovalve 17.

When the washing machine begins the drying stage, valves 14 and 17 open and the steam produced by heater 11 enters heat exchanger 15, supplying the circulating air with the heat necessary for heating it up to the operating temperature. The drying air operating temperature is controlled by a thermostat 18 located inside drying air inlet pipe 8, which causes valves 14 and 17 to close when the air has reached a set temperature, thus interrupting steam feed to exchanger 15. Thermostat 18 keeps the drying air at a constant temperature by allowing or shutting off steam feed to exchanger 15.

Advantageously exchanger 15 is of the type having a finned surface.

The heating system is a closed circuit, as no steam is consumed, but only heat is delivered to the users, i.e. to distiller 3 to vaporize the solvent contained in it, and to heat exchanger 15 to heat up the drying air.

Steam pressure inside the system is maintained at values around 2–2.5 bar and reaches a maximum pressure of 4.5 bar when there is not heat demand from the users. The maximum pressure is controlled by a pressure sensing device 21, mounted on return pipe 16 of exchanger 21, which shuts off resistors 12 when the maximum set value is reached.

The invention is not limited to the embodiment described and illustrated above, but includes any form of variation as encompassed in the appended claims.

I claim:

1. A dry-cleaning machine for linen and garments comprising:

a washing tank including an air inlet;

a drum, for containing the garments and/or linen to be washed, rotatable inside said washing tank;

an electric heater for producing steam;

means for circulating a solvent, connected with said tank and including a distillation device for continuously distilling the solvent with heat from said steam;

means for circulating drying air including an air heating means comprising a heat exchanger installed upstream from said air inlet to said washing tank, said air heating means using the steam as a heating medium.

2. The dry-cleaning machine according to claim 1, wherein said electric heater comprises a resistor, by means of which said steam is produced, interceptably communicating with said heat exchanger.

3. The dry-cleaning machine according to claim 1, wherein said heat exchanger includes a finned surface.

4. The dry-cleaning machine according to claim 1, wherein condensate coming from said heat exchanger is returned to said electric heater.

5. The dry-cleaning machine according to claim 1, wherein said electric heater is disposed inside said distillation device.

* * * * *